US005736817A

United States Patent [19]

Rothenbuhler et al.

[11] Patent Number: 5,736,817

[45] Date of Patent: Apr. 7, 1998

[54] PREHEATING AND STARTING CIRCUIT AND METHOD FOR A FLUORESCENT LAMP

[75] Inventors: Dan E. Rothenbuhler, Meridian; Samuel A. Johnson, Eagle; Glenn A. Noble, Nampa; Jon P. Seubert, Caldwell, all of Id.

[73] Assignee: Beacon Light Products, Inc., Meridian, Id.

[21] Appl. No.: 530,673

[22] Filed: Sep. 19, 1995

[51] Int. Cl.[6] ..... H05R 37/02

[52] U.S. Cl. ..... 315/106; 315/101

[58] Field of Search ..... 310/101, 106, 310/107

[56] References Cited

U.S. PATENT DOCUMENTS

| | | | |
|---|---|---|---|
| 3,265,930 | 8/1966 | Powell, Jr. | 315/209 R |
| 3,422,309 | 1/1969 | Spira et al. | 315/194 |
| 3,707,648 | 12/1972 | Rosa | 315/231 |
| 3,851,209 | 11/1974 | Murakami et al. | 315/99 |
| 3,919,590 | 11/1975 | Remery et al. | 315/101 |
| 3,925,705 | 12/1975 | Elms et al. | 315/246 |
| 3,927,345 | 12/1975 | Locata et al. | 315/DIG. 5 |
| 3,935,505 | 1/1976 | Spiteri | 315/194 |
| 3,942,070 | 3/1976 | Tomura et al. | 315/101 |
| 3,990,000 | 11/1976 | Digneffe | 323/24 |
| 4,087,723 | 5/1978 | Chermin et al. | 315/207 |
| 4,099,099 | 7/1978 | Grüdellbach | 315/194 |
| 4,107,579 | 8/1978 | Bodine, Jr. et al. | 315/205 |
| 4,119,887 | 10/1978 | Iyama et al. | 315/101 |
| 4,165,475 | 8/1979 | Pegg et al. | 315/101 |
| 4,181,872 | 1/1980 | Chermin | 315/99 |
| 4,329,627 | 5/1982 | Holmes | 315/209 R |
| 4,350,935 | 9/1982 | Spira et al. | 315/106 |
| 4,447,759 | 5/1984 | Moerkens et al. | 315/60 |
| 4,447,763 | 5/1984 | Iyama et al. | 315/101 |
| 4,460,848 | 7/1984 | Fahnrich | 315/101 |

(List continued on next page.)

FOREIGN PATENT DOCUMENTS

| | | |
|---|---|---|
| 46395 | 2/1982 | European Pat. Off. . |
| 471215 | 2/1992 | European Pat. Off. . |
| 471332 | 2/1992 | European Pat. Off. . |
| 9100552 | 4/1991 | Germany . |
| 2234868 | 2/1991 | United Kingdom . |
| WO A96/22007 | 7/1996 | WIPO . |

OTHER PUBLICATIONS

Starlight TN22 Preliminary Data Sheet, *SGS Thompson Microelectronics*, Nov. 1991, pp. 1/5–5/5.

Co-pending application Serial No. 08/616,541; Attorney Docket No. 083.319.

Co-pending application Serial No. 08/616,739; Attorney Docket No. 083.327.

*Primary Examiner*—Robert Pascal
*Assistant Examiner*—Michael Shingleton
*Attorney, Agent, or Firm*—John R. Ley

[57] ABSTRACT

The cathodes of a fluorescent lamp are preheating and the medium between the cathodes is ignited into a plasma by heating the cathodes for a predetermined warm-up time period by conducting current from a supply power source through the cathodes for a conductive time interval, and applying a relatively high voltage starting pulse to the cathodes at the end of the conductive time interval or alternatively suppressing the high voltage starting pulse during the predetermined warm-up time period. Suppressing the high voltage starting pulse during the warm-up time period, thereby preventing erosion the thermionic coating of the cathodes due to positive ion bombardment. A controllable semiconductor switch is connected to the cathodes to control the current flow through them. The high voltage starting pulse is derived from commutating the semiconductor switch into a nonconductive state when the applied current level drops to the characteristic holding current value of the switch. The high voltage starting pulse is suppressed by triggering the semiconductor switch at the time when it would otherwise be commutating to the nonconductive state.

25 Claims, 5 Drawing Sheets

U.S. PATENT DOCUMENTS

| | | | |
|---|---|---|---|
| 4,507,569 | 3/1985 | Hess, II | 307/135 |
| 4,527,099 | 7/1985 | Capewell et al. | 315/291 |
| 4,629,944 | 12/1986 | Maytum et al. | 315/101 |
| 4,649,323 | 3/1987 | Pearlman et al. | 315/200 R |
| 4,651,060 | 3/1987 | Clark | 315/199 |
| 4,673,844 | 6/1987 | Maytum et al. | 315/200 R |
| 4,733,138 | 3/1988 | Pearlman et al. | 315/307 |
| 4,847,535 | 7/1989 | Wisbey et al. | 315/101 |
| 4,870,340 | 9/1989 | Kral | 323/235 |
| 4,885,507 | 12/1989 | Ham | 315/244 |
| 4,888,527 | 12/1989 | Lindberg | 315/282 |
| 4,899,088 | 2/1990 | Black, Jr. et al. | 315/221 |
| 5,004,960 | 4/1991 | Cockram et al. | 315/503 |
| 5,010,274 | 4/1991 | Phillips et al. | 315/101 |
| 5,030,890 | 7/1991 | Johnson | 315/208 |
| 5,049,789 | 9/1991 | Kumar et al. | 315/289 |
| 5,055,746 | 10/1991 | Hu et al. | 315/291 |
| 5,221,877 | 6/1993 | Falk | 315/291 |
| 5,264,761 | 11/1993 | Johnson | 315/291 |
| 5,396,152 | 3/1995 | Bönigk | 315/241 R |
| 5,477,109 | 12/1995 | Chermin et al. | 315/106 |
| 5,504,398 | 4/1996 | Rothenbuhler | 315/209 R |
| 5,537,010 | 7/1996 | Johnson et al. | 315/289 |

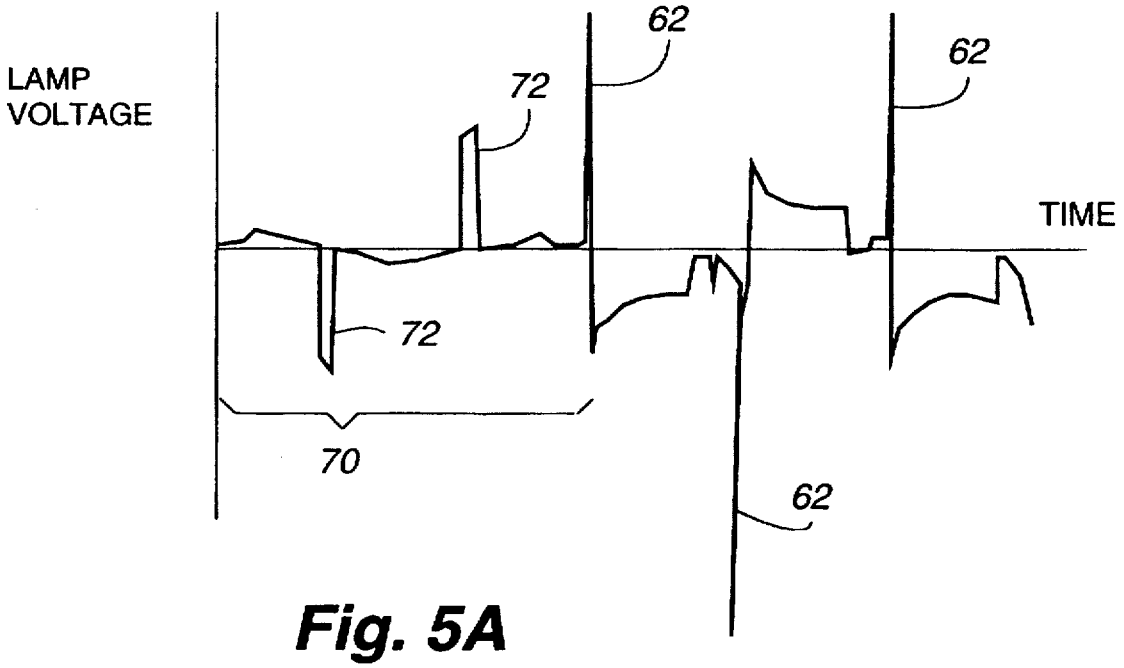
Fig. 5A
Fig. 5B
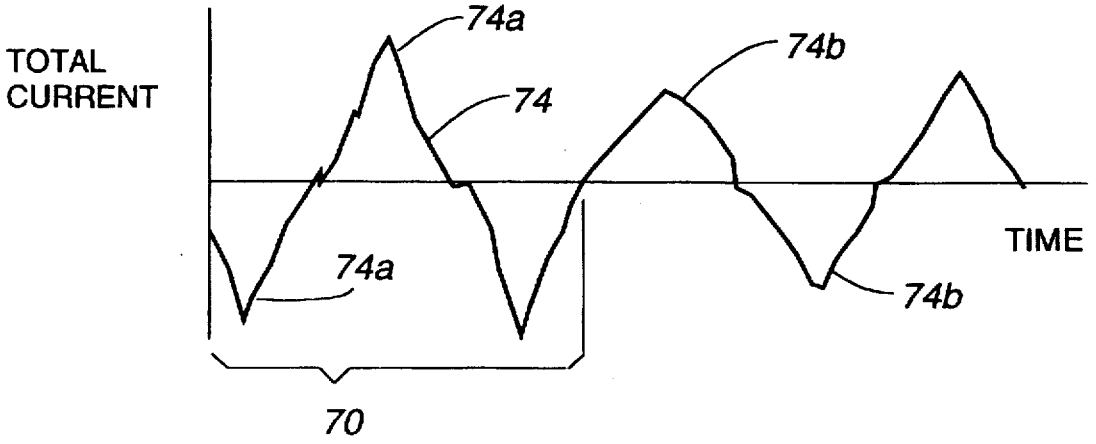

INITIALIZE
SET TIMER TO ZERO.
SET COUNTER TO ZERO
150

WAIT FOR ZERO CROSS
152
156
IS TIMER LESS THAN WARM-UP ?
YES
TRIGGER SWITCH
154
NO
158
162
IS TIMER EQUAL TO WARM UP ?
YES
WAIT FOR SUPPRESSION TIME
NO
WAIT FOR SWITCH TRIGGER TIME
164
168
LAMP LIGHTED ?
NO
SET TIMER TO WARM-UP LESS T2 . SET COUNTER TO ZERO
166
YES
TRIGGER SWITCH INCREMENT COUNTER
170
TRIGGER SWITCH
160
YES
COUNTER LESS THAN N ?
172
NO
DONE WITH START
174

PREHEATING AND STARTING CIRCUIT AND METHOD FOR A FLUORESCENT LAMP

CROSS REFERENCE TO RELATED INVENTIONS AND APPLICATIONS

This is a continuation of U.S. patent application Ser. No. 08/530,563 for a "Resonant Voltage-Multiplying, Current-Regulating And Ignition Circuit For A Fluorescent Lamp", and Ser. No 08/530,563 for a "Method of Regulating Lamp Current Through a Fluorescent Lamp by Pulse Energizing a Driving Supply", filed concurrently herewith by some of the same inventors designated in this application.

This invention relates to fluorescent lamps and other similar types of discharge lamps. More particularly, this invention relates to a new and improved circuit and method for preheating and starting a fluorescent lamp which is driven by a resonant circuit or other regularly interrupted energizing source which is incapable of delivering continuous power in amounts which are sufficient to quickly preheat the lamp for reliable starting.

This invention incorporates features described in U.S. patent application Ser. No. 08/258,007 for a "Voltage-Comparator, Solid-State, Current-Switch Starter for Fluorescent Lamp," filed Jun. 10, 1994, now U.S. Pat. No. 5,537,010; Ser. No. 08/404,880 for a "Dimming Controller for a Fluorescent Lamp," filed Mar. 16, 1995, now U.S. Pat. No. 5,504,398; and Ser. No. 08/406,183 for a "Method of Dimming a Fluorescent Lamp," filed Mar. 16, 1995. This invention may also advantageously incorporate features described in U.S. Pat. No. 5,030,390 for a "Two Terminal Incandescent Lamp Controller," issued Jul. 9, 1991 and now reissued as Re Pat. No. 35,220. Furthermore, certain aspects of this invention may be advantageously accomplished by using the invention described in Ser. No. 08/257,899 for a "High Temperature, High Holding Current Semiconductor Thyristor," filed Sep. 9, 1994, now abandoned.

The inventions described in the preceding two paragraphs are assigned to the assignee of this present invention. The disclosures of all these applications are incorporated herein by this reference.

BACKGROUND OF THE INVENTION

Fluorescent lamps offer numerous advantages in illumination, compared to incandescent lamps, but fluorescent lamps require control equipment to operate properly and to obtain a reasonable longevity of use. Ballasts are required to limit the current flow in an arc between filament electrodes known as cathodes located at each end of the lamp. If the current is not limited by the ballast while the fluorescent lamp is operating, excessive lamp current will prematurely consume the cathodes. Starters are required to generate a high voltage starting signal which ionizes the medium between the cathodes into a conductive plasma. Photon energy from the plasma excites a phosphorescent coating of the lamp and creates the illumination from the lamp. Once initiated, the plasma can be sustained by the normal power supply mains voltage.

Starting the fluorescent lamp by igniting the plasma can present difficult problems and can contribute to the premature failure of the lamp. To start or ignite the plasma on a reliable basis, the cathodes must first be heated. A thermionic coating on the cathodes emits a cloud of electrons surrounding each cathode when the cathodes are heated. The cloud of electrons must be sizable enough to conduct the initial arc and thereby initiate the plasma. If the cathode has not been heated sufficiently, the cloud of electrons is insufficient to support the initial arc which initiates the conductive plasma within the lamp.

Heating the cathodes occurs naturally as a result of the current conducted between the cathodes during normal and sustained operation of the lamp. However, to start the lamp, the cathodes are typically preheated during a warm-up period before an initial high voltage pulse is applied to the cathodes to ignite the plasma. If the cathodes have not been sufficiently warmed, the lamp generally will not start and the preheating or warm-up sequence of operations must again be performed.

When the cathodes have not been warmed sufficiently and the high voltage starting pulse is delivered, positive ion bombardment severely erodes the thermionic coating on the cathodes. Positive ions result from the emission of the electrons from the thermionic coating, because the positive ions are the counterparts to the electrons. The positive ions are considerably more massive and slower moving than the electrons. The application of the high voltage starting pulse when the cloud of electrons is small due to insufficient heating of the cathodes causes the positive ions and the electrons to recombine at the surface of the thermionic coating rather than to establish the initial starting arc between the electrodes. The mass of the positive ions impacts or bombards the thermionic coating and results in serious erosion of that coating. Without a sufficient amount of the thermionic coating, the coating becomes incapable of generating sufficient electrons for starting the lamp on a reliable basis, and thereby contributes to a severely reduced usable lifetime of the lamp.

With normal operation, the thermionic coating will erode or evaporate slowly from the cathodes over a period of 10,000 to 20,000 hours of lamp use. Preheating or warming the cathodes to the optimum temperature and thereafter igniting the plasma with a single, short high voltage pulse can result in obtaining over 1,000,000 lamp starts before failure. With insufficient cathode preheating, the entire thermionic coating may be eroded in as few as 4,000 lamp starts. The difference in usable lamp life is especially important in applications were the lamp is turned on and off on a regular basis, such as in storage areas and spaces with occupancy sensors.

It is with respect to these and other considerations that the present invention has evolved.

SUMMARY OF THE INVENTION

In general, the present invention is directed to a new and improved technique of preheating the cathodes and suppressing the high voltage starting pulses during the preheating warm-up period to obtain optimal conditions for starting the lamp and preventing the premature failure of the lamp as a result of an eroded thermionic coating on the cathodes. The present invention is also directed to preheating the cathodes and suppressing the high voltage starting signal under conditions where a limited capacity energy source, for example a regularly interrupted energizing source such as a resonant circuit, supplies electrical energy to the lamp. The limited capacity source is incapable of heating the cathodes quickly, thereby accentuating the possibility of premature lamp failure from positive ion bombardment during preheating. Further, the present invention is directed to an improvement in the very effective starting technique described in U.S. patent application Ser. No. 08/258,007 for a "Voltage-Comparator, Solid-State, Current-Switch Starter for Fluorescent Lamp," to allow the starting technique to be effectively employed regardless of whether a regularly interrupted energizing source delivers power to the lamp.

In accordance with one of its basic aspects, the present invention is directed to a preheating and ignition circuit for a fluorescent lamp which has cathodes and a medium between the cathodes which is ionizable into a conductive plasma. Electrical energy is applied in half-cycles from a power source through a ballast to the lamp. A controllable switch is adapted to be connected in series with the cathodes. A controller controls and establishes conductivity states of the switch. The controller includes information defining a warm-up time period of predetermined time duration during which the cathodes are heated. The controller triggers the switch into a conductive state during a conductive time interval to conduct current through the cathodes and thereby heat the cathodes. The controller causes the switch to commutate into a nonconductive state at the end of the conductive time interval after the expiration of the predetermined warm-up time period, and the controller delivers a suppression signal to trigger the switch into a conductive state prior to the end of the conductive time interval before expiration of the predetermined warm-up time period.

The suppression signal has the effect of suppressing the high voltage starting pulse during the warm-up time period, thereby preventing erosion the thermionic coating of the cathodes due to positive ion bombardment.

Another important aspect of the present invention which achieves the same desirable effect of preventing erosion of the thermionic coating of the cathodes involves a method of preheating and igniting a plasma in a fluorescent lamp which has cathodes and a medium between the cathodes which is ionizable into the plasma. The method comprises the steps of applying electrical energy in half-cycles from a power source to the cathodes, heating the cathodes for a predetermined warm-up time period by conducting current from the source through the cathodes for a predetermined conductive time interval, applying a relatively high voltage starting pulse to the cathodes at the end of the conductive time interval, and suppressing the high voltage starting pulse during the predetermined warm-up time period.

Preferred features of both aspects of the invention include generating the relatively high voltage starting pulse from the effect of a relatively large decrease in current conducted through the cathodes in a relatively short time (di/dt) at the termination of the conductive time interval, by applying the di/dt effect to a ballast inductor through which current is delivered to the lamp, and suppressing the di/dt effect during the predetermined warm-up time period. A controllable switch is preferably connected to the cathodes to conduct current through the cathodes when the switch is in a conductive state, and the suppression signal triggers the switch into the conductive state prior to and during the end of the conductive time interval before expiration of the predetermined warm-up time period. The di/dt effect is generated by commutating the switch into a nonconductive state by allowing the half-cycle of applied current to decrease below a characteristic holding current level of a semiconductor switch. The high voltage starting pulse is suppressed by triggering the semiconductor switch into the conductive state when the half-cycle of applied current decreases to the holding current level of the semiconductor switch. Zero crossing points of the half-cycles are detected and the suppression signal is delivered based on timing information derived relative to the detected zero crossing point. Determinations are made after the delivery of the high voltage starting pulse to determine if the plasma ignited, and if not, to establish a supplementary warm-up time period for heating the cathodes. The aspects of the present invention are particularly useful when the power source is a regularly interrupted power supply such as a resonant circuit.

A more complete appreciation of the present invention and its scope may be obtained from the accompanying drawings, which are briefly summarized below, from the following detailed description of a presently preferred embodiment of the invention, and from the appended claims which define the scope of this invention.

BRIEF DESCRIPTION OF THE DRAWINGS

FIGS. 5A and 5B are waveform diagrams on an equivalent time axis of the voltage across the lamp and the current delivered to the lamp during a preheating and starting sequence for the lamp.

DETAILED DESCRIPTION

Figure 1:
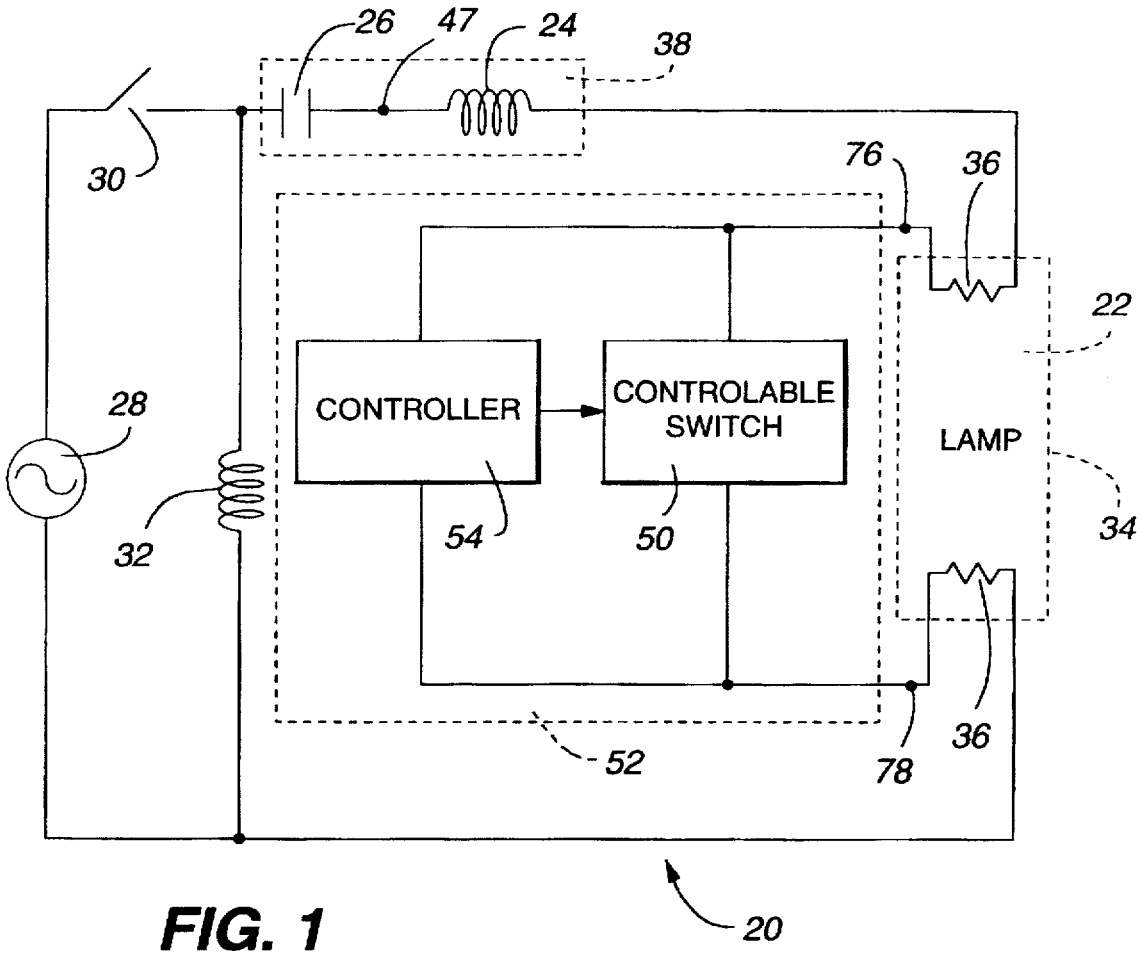
FIG. 1 is a simplified block and schematic circuit diagram of a fluorescent lamp circuit which incorporates a preheating and starting circuit and control module of the present invention, shown connected to a conventional AC power source and controlled by a manual switch.

The features of the present invention are embodied in a fluorescent lamp control circuit 20 shown in FIG. 1. The lamp control circuit 20 includes a fluorescent lamp 22, an inductor 24, known as a ballast, and a capacitor 26, all of which are connected in series. Conventional alternating current (AC) power from an AC source 28 is applied to the series connected lamp 22, inductor 24 and capacitor 26 through a power control switch 30, such as a conventional wall-mounted on/off power switch. An optional power factor correcting inductor 32 may be connected in parallel with the series connection of the inductor 24, capacitor 26 and lamp 22.

The fluorescent lamp 22 is conventional and is formed of an evacuated translucent housing 34. Two filament electrodes known as cathodes 36 are located at opposite ends of the housing 34. A small amount of mercury is contained within the evacuated housing 34. When the lamp 22 is lighted, the mercury is vaporized and ionized into a conductive medium, and current is conducted between the cathodes 36 through the ionized mercury medium creating a plasma. Energy from the plasma excites a phosphorescent coating inside the housing 34, and illumination from the lamp results. Due to the well-known negative impedance conductivity characteristics of the plasma medium, the ballast 24 is necessary to limit the current flow through the plasma, thereby preventing the cathodes 36 from burning out prematurely.

The inductor 24 and energy storage capacitor 26 form a resonant energy storage and voltage boosting circuit 38. The inductance and capacitive values of the inductor 24 and the capacitor 26, respectively, are selected to create a natural resonant frequency for the resonant circuit 38 which is different from the frequency of the AC power applied from the source 28. Even though the resonant circuit 38 has a natural frequency which is different from the frequency of the AC source 28, the driving effect of the AC source 28 causes the frequency of the resonant circuit 38 to match the frequency of the AC source 28.

Although the resonant circuit 38 does not oscillate at its natural frequency, its natural resonant frequency is sufficiently close to the AC power source frequency to provide significant energy storage capability at the frequency of the source 28. The energy stored in the resonant circuit 38 has the effect of boosting or increasing the voltage supplied to the lamp 22.

The output voltage from the resonant circuit 38 is greater than the output voltage from the AC power source 28 by an amount related to the energy stored in the resonant circuit 38. Viewed from the standpoint of node 47, the inductor 24 and the lamp 22 are driven with a higher voltage signal than they would be driven by the AC source 28 without use of the resonant circuit.

To store the energy in the resonant circuit 38 which is later released as an increased output voltage and an increased lamp current, a controllable switch 50 draws current from the source 28 during a conductive time interval to energize the inductor 24 and capacitor 26, as is understood from FIG. 1. The controllable switch 50 is part of a control module 52. The switch 50 is triggered by a controller 54 which is also part of the control module 52. Since any impedance between the cathodes 36 is effectively removed from the circuit when the switch 50 is conductive, because the short-circuiting effect of the conductive switch 50, substantially all the voltage from the source 28 is applied across the resonant circuit 38. The relatively low impedance characteristics of the resonant circuit 38 causes more current flow through the resonant circuit 38 during a conductive time interval when the switch 50 is closed than during the time when the switch 50 is open or nonconductive. The energy from the increased current conducted by the conductive switch 50 through the resonant circuit 38 is stored in the inductor 24 and capacitor 26. This increased current is hereinafter referred to as a charging current. The energy from the charging current is added to the energy normally supplied by the source 28, and the resulting energy supplied to the lamp 22 is greater than the level of energy which the source 28 itself is capable of supplying to the lamp.

The conductive time interval during which the charging current is conducted preferably occurs near the end of each half-cycle of applied AC current delivered to the lamp 22 and the control module 52. Locating the conductive time interval at the end of the half-cycle coordinates the charging current with the ability to reliably ignite or start the plasma in the lamp. The capability to ignite the plasma and start the lamp is described in detail in the previously mentioned U.S. patent application Ser. Nos. 08/258,007; 08/404,880 and 08/406,183.

Figure 2A:
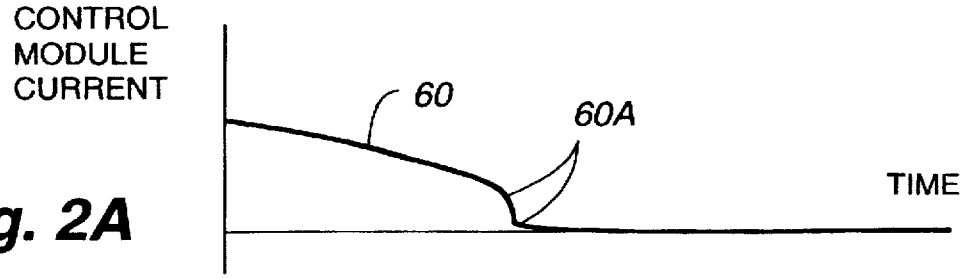
FIGS. 2A and 2B are waveform diagrams on an equivalent time axis of current conducted through the control module and voltage applied to the fluorescent lamp, respectively, which are shown in FIG. 1, during a time when the current from the source is passing through a zero crossing point.

As described in more detail in these applications, the high voltage starting pulse occurs by commutating the switch 50 into a nonconductive state as the applied half-cycle of current approaches a zero value when the applied current nears a zero crossing point at the end of the half-cycle. The waveform shown in FIG. 2A illustrates a current 60 conducted by the control module near the end of the applied current half-cycle. As the current 60 decreases, the switch 50 commutates to a nonconductive condition at 60*a*, resulting in the applied current immediately decreasing to approximately zero. The rapid decrease in current in a relatively short or instantaneous time causing a relatively high change in current per change in time (di/dt).

Figure 2B:
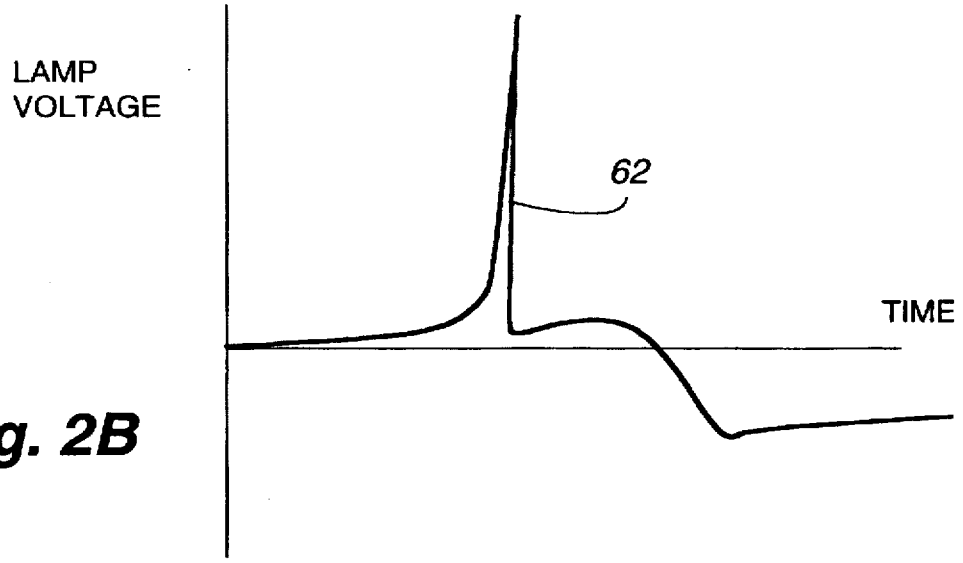

The inductor 24 in the resonant circuit 38 responds to the di/dt effect and generates a relatively high voltage pulse 62, shown in FIG. 2B. The magnitude of the high voltage pulse 62 may be three to five times greater than the voltage applied from the resonant circuit 38 or the AC source 28, and this magnitude is sufficient to ignite the plasma, thus lighting the lamp. Once the plasma is ignited during a first few half-cycles of voltage applied to the lamp, the plasma state will be maintained in response to the application of normal driving voltages from the resonant circuit 38, even between sequential half-cycles of applied voltage when the plasma is momentarily extinguished as the applied voltage transitions through the zero crossing points.

By triggering the conductive switch 50 into a conductive state during the conductive time interval at the end of the applied current half-cycle, the conductive state of the switch 50 is in condition to commutate into the nonconductive state and deliver the high voltage starting pulse 62 at the end of the applied current half-cycle. Preferably, the switch 50 includes a semiconductor switch such as a thyristor, triac or SCR which has a characteristic high holding current, such as is described in U.S. patent application Ser. No. 08/257,877. The holding current is that value of current 60 at which the semiconductor switch commutates to a nonconductive state. By triggering the semiconductor switch into the conductive state at the beginning of the conductive time interval of the charging current, the termination of the conductive time interval occurs from commutation of the semiconductor switch at the time when it is desired to deliver the high voltage starting pulse 64. Thus, the conductivity of the switch in establishing the conductive time interval for the charging current coordinates with the commutation of the switch to generate the high voltage starting pulse.

Control over the amount of charging current is determined by the point in time during each applied current half-cycle when the switch 50 is triggered. U.S. patent application Ser. No. (083,323) and Ser. No. (083,325) describe the manner of adjusting the time width of the conductive time interval to regulate the current through the lamp while it is operating.

A particular problem occurs in starting the fluorescent lamp when a regularly interrupted energizing source circuit such as the AC source 28 in combination with the resonant circuit 38 is employed in starting the fluorescent lamp 22. The resonant circuit 38 is not capable of delivering continuous or DC current, because of the blocking nature of the capacitor 26. Therefore, the cathodes 36 can not be preheated during a warm-up period by continuous current conducted by the conductive switch 50. In non-interrupted energizing sources such as the AC source 28 by itself without the resonant circuit, the conduction of the switch 50 during a warm-up period will result in substantial current being drawn through the inductor to quickly heat the cathodes. This technique of heating the cathodes 36 during a warm-up period prior to starting or lighting the lamp is described in U.S. patent application Ser. No. 08/258,007. This technique, however, can not be employed with regularly interrupted energizing sources such as the resonant circuit 38.

Even though the capacitor 26 of the resonant circuit 38 blocks a sizable current flow, the controller 54 can still trigger the switch 50 into conduction during each applied current half-cycle and thereby heat the cathodes during a warm-up time period. However the amount of current conducted is limited. The limited current will eventually heat the cathodes to a satisfactory thermionic emission level, but a longer warm-up time period extending over substantially more applied current half-cycles is required. For example, the starting procedure described in U.S. patent application Ser. No. 08/258,007 can usually heat the cathodes adequately for a reliable start in only 10 to 15 half-cycles of applied current. To heat the cathodes when the resonant circuit 38 is used with the lamp may require up to 120 half-cycles of applied current.

The time delay during the warm-up period is not necessarily objectionable. The more serious problem which results from the relatively long warm-up period is that the high voltage pulses 62 are also supplied during the warm-up period. Applying the high voltage pulses 62 when the cathodes have not been sufficiently heated to ignite the plasma has the effect of substantially eroding the thermionic coating on the cathodes from positive ion bombardment. This, of course, substantially reduces the usable life of the lamp.

To prevent premature failure of the lamp from positive ion bombardment during warm-up periods, the high voltage starting pulse 62 is suppressed at the end of each half-cycle of current applied to heat the cathodes during the warm-up time period.

The present invention is primarily useful for use with fluorescent lamps energized by a regularly interrupted power source, but the improvements of the present invention may also be obtained during the warm-up period even when continuous energizing sources supply power to the fluorescent lamp.

Figure 3:
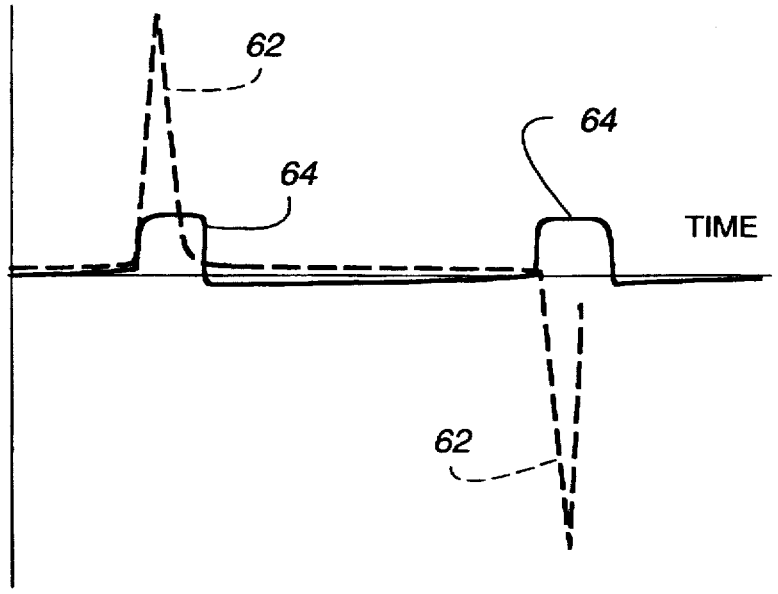
FIG. 3 is an illustrative graph of a high voltage starting pulse shown in FIG. 2A superimposed with a trigger signal supplied to a controllable switch of the control module shown in FIG. 1.

To suppress the high voltage starting pulse 62, the controller 54 delivers a suppression signal 64 (FIG. 3) to trigger the switch 50 into conduction at a predetermined time slightly before that time when the switch 50 would normally commutate to a nonconductive state. The duration of the suppression signal 64 extends over the time period beginning slightly before the time that the high voltage starting pulse 62 would be generated, as shown in FIG. 3. The suppression signal 64 causes the switch 50 to remain conductive until the applied half-cycle of current decreases to zero when the applied lamp current reaches the zero crossing point.

Figure 4A:
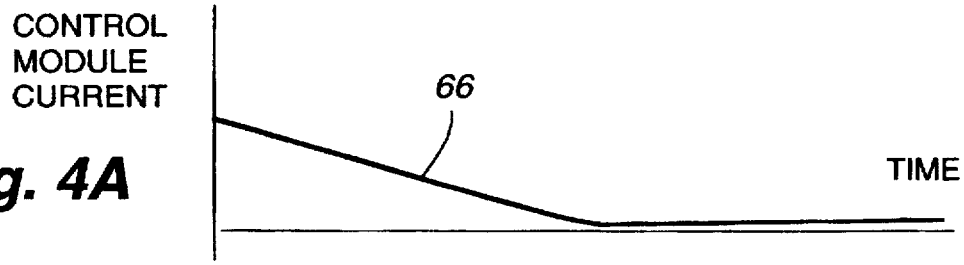
FIGS. 4A and 4B are waveform diagrams on an equivalent time axis of current conducted through the control module and voltage applied to the fluorescent lamp, respectively, which are shown in FIG. 1, during a time when the current from the source is passing through a zero crossing point and when the trigger signal shown in FIG. 3 is applied to suppress the high voltage pulse shown in FIG. 3.
Figure 4B:
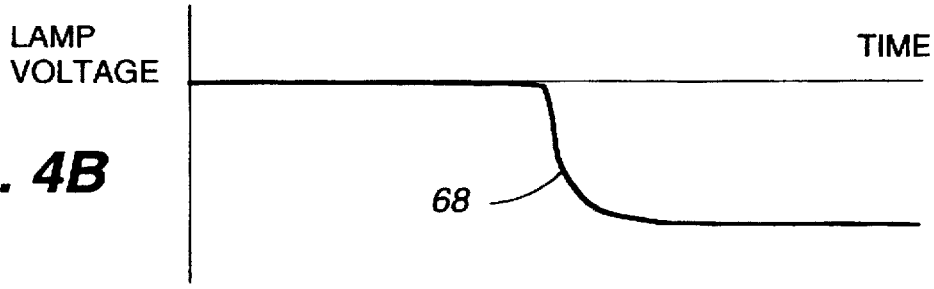

The effect is better illustrated in FIGS. 4A and 4B. A current 66 which flows through the control module as a result of the conductive time interval for the charging current decreases toward zero at the end of the applied current half-cycle, as shown in FIG. 4A instead of undergoing a rapid change in a relatively short time period, as is case illustrated at 60*a* in FIG. 2A, the current 66 continues decreasing smoothly to zero. The smooth decrease in current does not create a sizable di/dt effect which would result in the generation of a high voltage starting pulse. Instead, the voltage 68 across the lamp transitions to the value of the driving voltage supplied to the lamp, as shown in FIG. 4B.

Timing information for controlling the delivery of the suppression signal 64 is obtained from timing information derived from a zero crossing detector associated with the controller 54 and information describing the time width of each applied current half-cycle at the operating frequency of the lamp. Furthermore, since the high voltage starting pulses 62 are necessary only when the lamp is not lighted, the controller 54 includes a voltage sensing circuit to sense the voltage between the cathodes, and hence across the plasma, to determine whether the lamp is lighted or not. Determining whether the lamp is lighted or not allows the controller to institute or modify a starting sequence of operations which results in preheating and lighting of the lamp.

In the case of the switch 50 being a semiconductor switch such as a thyristor, triac or SCR, the suppression signal 64 is delivered slightly before the current conducted by the switch decreases to the characteristic holding current level of the semiconductor switch. The suppression signal 64 has the effect of maintaining the semiconductor switch in a conductive state with current flowing through the power terminals (anode and cathode) as the applied current 66 decreases through the holding current level to the zero level.

Thus, during a starting sequence of operations according to the present invention, the high voltage starting pulses are suppressed during a predetermined warm-up time period. FIG. 5A illustrates the ending portion of a warm-up period 70. After the cathodes 36 have been warmed to obtain the desired level of thermionic emission, the warm-up period 70 ends and the first high voltage starting pulse 62 is delivered. The current 74 which flows through the cathodes during the warm-up period 70 is shown in FIG. 5B. The amount of current 74 which flows during the warm-up period 70 is greater than the amount of current 70 which flows after the warm-up period, as is represented by the higher peaks 74*a* of the current 74 flowing during the warm-up period compared to the reduced peaks 74*b* of current 74 flowing after the warm-up period.

While it is desirable to ignite the plasma with the first starting pulse 62, the lamp may not light immediately, in which case a few subsequent starting pulses 62 may be delivered in succession. Preferably, however, if the lamp does not light in response to the application of a predetermined number of high voltage starting pulses, the controller 54 will enter into a supplementary warm-up period during which the high voltage pulses are again suppressed and the cathodes are further heated. The supplementary warm-up period is usually shorter in time duration than the initial warm-up time period since the cathodes will have previously been heated to some degree, although not sufficiently to ignite the plasma in response to the first few high voltage starting pulses.

During the warm-up time period 70 shown in FIG. 5A, pulses 72 occur during each applied current half-cycle. The pulses 72 are established by the controller 54 for the purpose of energizing the control module 52. The control module 52 obtains its power from the power delivered to the cathodes of the lamp. If the power delivered to the cathodes was entirely consumed in heating those cathodes there would be no remaining power to keep the control module active and operating. Therefore, the control module establishes the very short time width energizing pulses 72 to allow enough power to be delivered to the control module 52 to keep it energized. The energizing pulses 72 are created by a slight delay in triggering the conductive switch after the applied current transitions through the zero crossing point. By delaying the conductivity of the switch for the time width of the energizing pulses 72, the voltage across the cathodes 36 is allowed to build slightly, thereby energizing the control module. The time width of the energizing pulses should not be so substantial as to allow the magnitude of the voltage during the energizing pulses 72 to reach a high enough value that it could cause positive ion bombardment.

Figure 6:
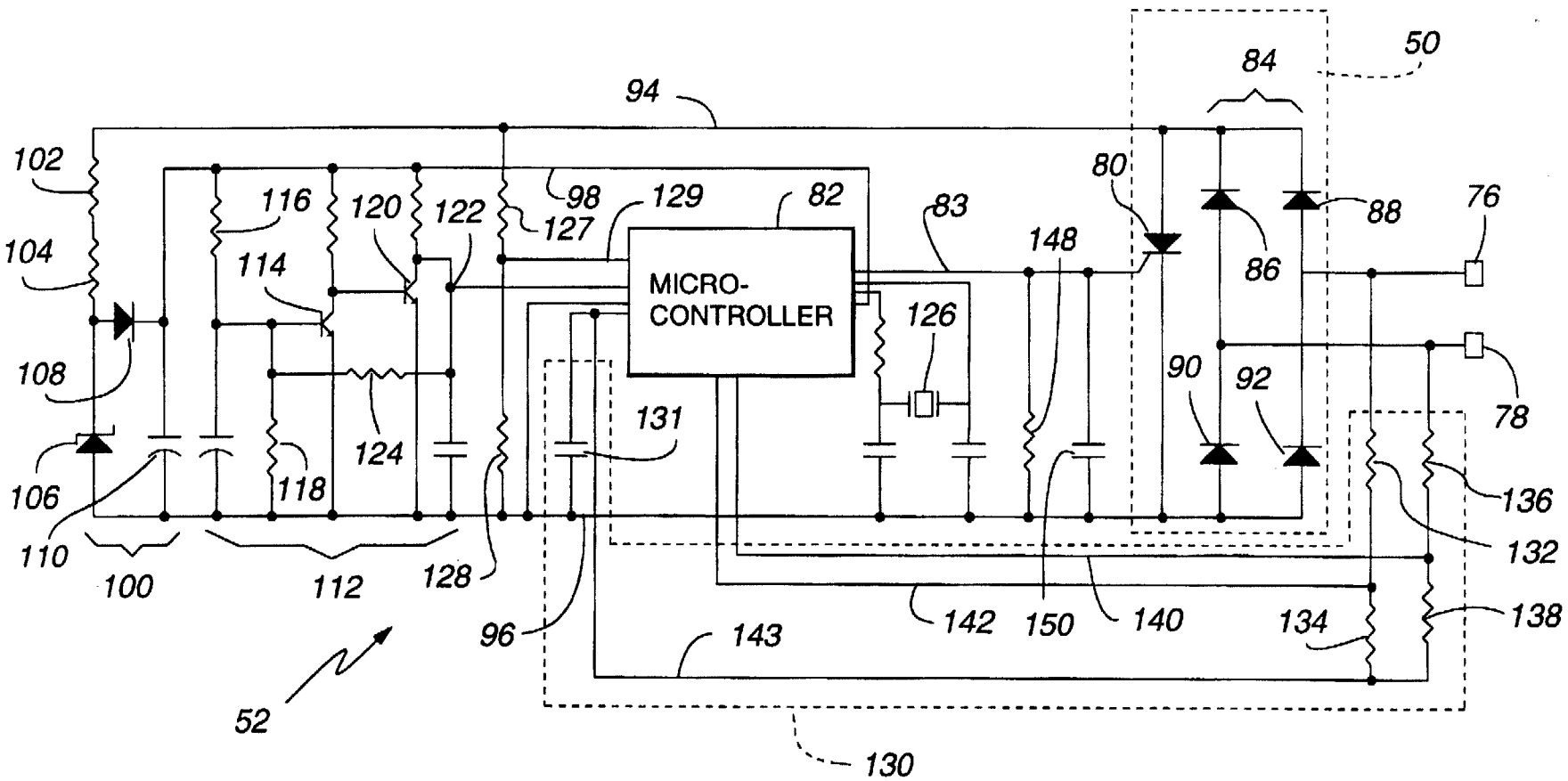
FIG. 6 is a schematic circuit diagram of the control module shown in FIG. 1.
Figure 7:
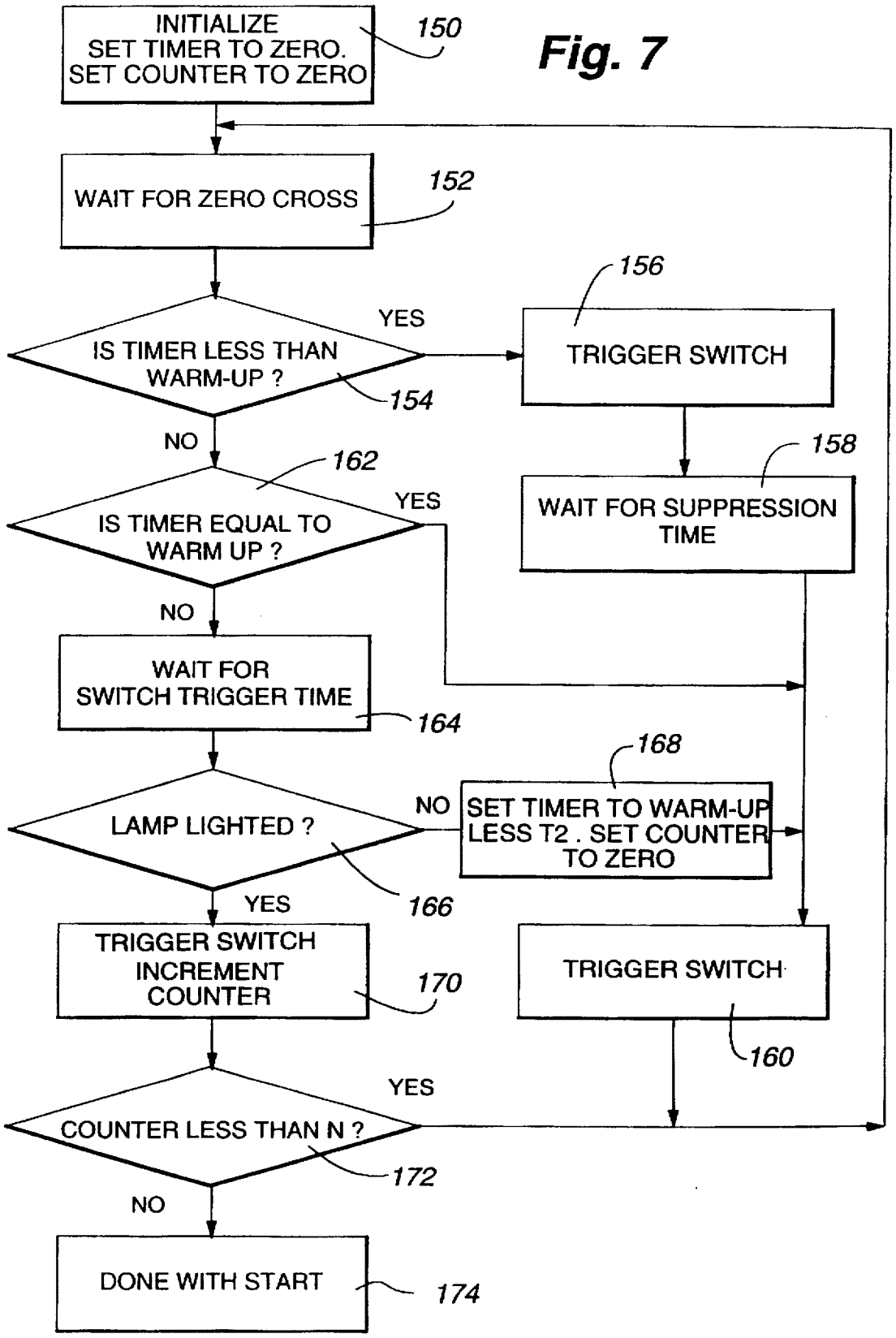
FIG. 7 is a flow chart of the sequence of operations performed by the control module shown in FIG. 1 to achieve the preheating and starting sequence of the lamp according to the present invention.

The manner in which the control module 52 operates to achieve the described functions is more completely understood by reference to the schematic diagram of the module 52 shown in FIG. 6 and the flow chart shown in FIG. 7.

As shown in FIG. 6, the control module 52 is connected at terminals 76 and 78 to the lamp cathodes 36 (FIG. 1). The control module 52 includes many of the components of the solid state starter described in U.S. patent applications previously referred to above, including a high holding current thyristor, triac, or other semiconductor current switch having the operational characteristics described in application Ser. No. 08/257,899. A SCR 80 is one example of such a controllable current switch 50.

A microcontroller 82, or other logic circuit or state machine, establishes the conductive time interval for the charging current and also controls the delivery of the suppression signal 64 by applying a trigger signal on a conductor 83 connected to the SCR 80. The microcontroller 82 achieves these control functions in accordance with control information which has been preprogrammed into its memory (not shown). The memory of the microcontroller 82 also includes the information which describes a predetermined time period for the initial warm-up period, and information describing the holding current level of the SCR 80 and other information which allows the timing of the suppression signal 64 to occur before the current level decreases to the holding current level at the end of the half-cycle of applied current. The program flow employed by the microcontroller 82 to deliver the suppression signal and to establish the initial and the subsequent warm-up time periods is generally shown in FIG. 7.

A full wave rectifying bridge 84 is connected between the SCR 80 and the terminals 76 and 78. The rectifying bridge 84 is formed by diodes 86, 88, 90 and 92. The bridge 84 rectifies both the positive and negative half-cycles of applied current and applies a positive potential at node 94 and negative potential at node 96. The anode power terminal and the cathode power terminal of the SCR 80 are connected to the nodes 94 and 96, respectively. Conduction of the SCR 80 will conduct current through the lamp cathodes 36 during both the positive and negative half-cycles of the AC power, due to the steering or rectifying effect of the rectifying bridge 84. The SCR 80 and the rectifying bridge 84 are one example of the controllable switch 50 shown in FIG. 1.

DC power for the microcontroller 82 is supplied at node 98 by a power supply 100 which includes resistors 102 and 104, a voltage-regulating Zener diode 106, a blocking diode 108 and a storage capacitor 110. The storage capacitor 110 charges through the diode 108 to approximately the breakdown level of the Zener diode 106. The Zener diode 106 establishes the voltage level of the power supply 100 at the node 98. During power interruptions and zero crossings of the applied AC voltage, the blocking diode 108 prevents the storage capacitor 110 from discharging. The storage capacitor 110 holds sufficient charge to maintain the microcontroller 82 in a powered-up operative condition during the times of zero crossings of the applied AC power. Power for the module 52 is obtained from the terminals 76 and 78 when the SCR 80 is not conductive, during the energizing pulse periods 72 shown in FIG. 5A.

A reset circuit 112 is connected to the storage capacitor 110 for the purpose of disabling and resetting the microcontroller 82. The microcontroller 82 is disabled until the voltage across the storage capacitor 110 reaches the proper level to sustain reliable operation. The microcontroller 82 is reset when the power supply voltage across the storage capacitor 110 drops below that level which sustains reliable operation of the microcontroller.

The reset circuit 112 includes a transistor 114 which has its base terminal connected to a voltage divider formed by resistors 116 and 118. Until the power supply voltage across the storage capacitor 110 reaches a desired level, the voltage across the resistor 118 keeps the transistor 114 biased into a non-conductive state. When the transistor 114 is non-conductive, a transistor 120 is conductive, since the base of transistor 120 is forward biased by essentially any level of voltage at 98 which is greater than its forward bias voltage. With the transistor 120 forward biased, the voltage at node 122 is low. Node 122 is connected to a reset terminal of the microcontroller 82. While the voltage at the node 122 is low, the microcontroller 82 is held in a reset or inoperative state.

As the voltage across the power supply storage capacitor 110 increases, the voltage on the base of transistor 114 increases and eventually reaches the point where the transistor 114 starts to conduct. The conducting transistor 114 decreases the voltage at the base of transistor 120, causing transistor 120 to reduce its conductivity. The voltage at node 122 starts to rise, and this increasing voltage is applied by a feedback resistor 124 to the base of transistor 114. The signal from the resistor 124 is essentially a positive feedback signal to accentuate the effect of the increasing conductivity of the transistor 114. The positive feedback causes an almost instantaneous change in the conductivity characteristics of the transistors 114 and 120, resulting in an almost instantaneous jump in the voltage level at node 122. Consequently, the reset signal rapidly and cleanly transitions between a low and high level to establish an operative condition at the microcontroller 82. A similarly-acting but opposite-in-effect situation occurs when the voltage from the power supply capacitor 110 diminishes below the operating level of the microcontroller 82, due to the positive feedback obtained from the resistor 124.

A regulated frequency reference for the clock frequency of the microcontroller 82 is established by a crystal 126.

The voltage across the lamp at the cathodes 36 is sensed by a voltage sensing circuit which includes resistors 127 and 128 connected in series between the nodes 94 and 96. The resistors 127 and 128 form a voltage divider for reducing the magnitude of the voltage appearing between the nodes 94 and 96. The voltage between the nodes 94 and 96 is directly related to the voltage across the lamp because of the effect of the rectifying bridge 84. The connection point of the resistors 127 and 128 delivers a signal at 129 to a terminal of the microcontroller 82.

Adjustment of the values of the resistors 127 and 128 establishes a magnitude of the signal at 129 which can be directly used by the microcontroller 82. Furthermore, the microcontroller is preferably programmed to establish a single threshold value which is directly related to the magnitude of the the voltage across the lamp when it is lighted. If the magnitude of the signal appearing at 129 is greater than the threshold established by the microcontroller 82, an indication is obtained that the lamp did not light. A simple comparison of the signal at 129 with the programmed threshold establishes the basis for determining whether or not the lamp has lighted. Conversely, a signal at 129 which is less than the programmed threshold indicates that the lamp has lighted. The signals obtained at 129 are thus used to control the starting sequence of operations during the warm-up time period and the supplemental warm-up time period.

Although conventional analog to digital converters could be employed with the microcontroller to sense the lamp voltage more exactly, such converters add cost and complexity of the circuit. It is for the reason of reducing cost and complexity that the simple threshold comparison technique described in the preceding paragraph is employed to sense the voltage for controlling the program flow during the warm-up sequence. The present invention, however, encompasses the use of more sophisticated and complex techniques of sensing the lamp voltage.

The control module 52 includes a zero crossing detection circuit 130. The zero crossing detection circuit 130 is formed by a capacitor 131 and resistors 132, 134, 136 and 138. Conductors 140 and 142 connect to the junction point of resistors 136 and 138 and to the junction point of resistors 132 and 134, respectively. The capacitor 131 references the signals on conductors 140 and 142 to the reference potential at node 96. The resistors 132, 134, 136 and 138 form voltage dividers for reducing the voltage at the terminals 76 and 78 to levels on conductors 140 and 142 which are directly used by the microcontroller 82.

The voltages on the conductors 140 and 142 are recognized by the microcontroller 82 to identify the zero crossings of the half-cycles of AC voltage, which are applied across the lamp cathodes connected to the terminals 76 and 78. The zero crossing points are employed to derive timing information for delivering the suppression signals at 83 to the SCR 80 and thereby suppress the high voltage starting pulse, and for measuring the lamp voltage signal 129 at a predetermined time after which the high voltage starting pulse has been delivered to determine whether the lamp is lighted or not.

The microcontroller 82 alternately connects one of the two conductors 140 and 142 to the reference potential at node 96 during successive half-cycles of current applied to the lamp. For example, during one half-cycle, the connector 140 is connected to the reference potential through the microcontroller. The microcontroller establishes a very high or infinite impedance on the other connector 142. Under these circumstances, a voltage divider exists through the resistors 132, 134 and 138. The junction of the resistors 136 and 138 is connected to the reference potential at the connector 140. A conductor 143, which is connected to the junction of resistors 134 and 138, supplies a signal from the resistors 132, 134, 136 and 138 to the microcontroller. The signal supplied on conductor 143 is a value related to and less than the voltage appearing on terminal 76, due to the voltage reducing effects of the voltage divider resistors 132, 134 and 138. When the voltage on terminal 76 transitions through the zero point, the microcontroller 82 recognizes this fact by comparing the signal level on conductor 143 with the reference potential at node 96.

Once the zero crossing point has been detected, the connection and impedance levels of the conductors 140 and 142 is reversed. The reversed or alternative state of the conductors 140 and 142 from the example started in the preceding paragraph is that conductor 142 is connected to the reference potential of node 96 and conductor 140 is placed at a high impedance level. The voltage from terminal 78 is applied to the resistors 136, 138 and 134, and the resulting voltage on the conductor 143 is representative of the voltage appearing across the lamp cathodes during this subsequent half-cycle. When the zero crossing point is recognized by the microcontroller, the impedance and connection states of the conductors 140 and 142 is again reversed.

The zero crossing detection circuit 130 causes the voltage applied at the conductor 143 to be positive. The voltage dividing resistors reduce the level of voltage from the terminals 76 and 78 to a value which can be directly used by the microcontroller. Furthermore a simple comparison of the voltage at the conductor 143 with the reference potential obtains a convenient and reliable determination of the zero crossing point. More complex and extensive techniques for determining the zero crossing point could be incorporated as a part of the present invention, but the technique disclosed offers simplicity and reliability without substantial additional cost.

A trigger signal on the conductor 83 controls the conductivity of the SCR 80, both to initiate the conductive time interval during which the charging current adds energy to the inductor 24 and capacitor 26 and to maintain conductivity of the SCR when the applied half-cycle current reaches the holding current level of the SCR 80, thereby suppressing the high voltage starting pulse. The microcontroller 82 establishes the time points at which the signals occur for initiating the start of the conductive time interval and for suppressing the high voltage starting pulse. A resistor 148 and a capacitor 150 form a filter for the pulse-like trigger signals at 83. In response to the trigger signal which initiates the conductive time interval alone the SCR 80 becomes conductive. The conductivity of the SCR 80 draws current through the cathodes 36 (FIG. 1). The rectifying effect of the bridge 84 causes current to flow through the cathodes regardless of the polarity of the half-cycle of the applied AC driving voltage. Once conductive, the SCR remains conductive until the applied half-cycle current level decreases to the holding current level. However, before the applied half-cycle current has reached the holding current level, the microcontroller 82 delivers the suppression signal 64 to the gate terminal of the SCR 80 to maintain the SCR in a conductive state until the applied half-cycle current decreases to the zero level at the zero crossing point.

The program flow executed by the microcontroller 82 to accomplish the sequence of starting operations previously described is shown in FIG. 7. The program flow begins at 150 where an internal timer and an internal counter within the microcontroller 82 are set to zero. The internal timer governs the length of the warm-up time period. The internal counter establishes the number N of half-cycles of voltage after the application of a high voltage starting pulse during which the voltage across the lamp cathodes is checked to determine whether the lamp is lighted. Generally, the count number N is preferred to be two, since the ignition of the plasma in two successive applied half-cycles usually is a good indication that the lamp is lighted and will stay lighted.

With the occurrence of the next zero crossing point sensed at 152, a determination is made at 154 whether the timer value is less than the predetermined initial warm-up time period. If the timer value is less than the predetermined initial warm-up period, meaning that the cathodes have not yet been warmed sufficiently to attain the desired thermionic emission level, the switch 50 is triggered at 156 to conduct additional current through the cathodes and continue warming them. Thereafter, the program flow waits for the time to deliver the suppression signal 64, as determined at 158. When the time arrives to deliver the suppression signal, the suppression signal is delivered to trigger the switch as shown at 160. Triggering the switch at 160 has the effect of suppressing the high voltage starting pulse. The program flow then returns to wait for the next zero crossing as determined at 152.

Until the initial warm-up time period has been reached, the program flow progresses through the steps 152, 154, 156, 158 and 160. However, as soon as the predetermined warm-up time period has been reached as determined at 154, it is next determined at 162 whether the elapsed time is equal to the predetermined warm-up time period. If so, the switch is triggered at 160. The determination that the timer value is equal to the warm-up time period is necessary to assure that the voltage across the lamp will not be checked during the same half-cycle that the high voltage pulse has been applied. The voltage across the lamp must be checked in the following half-cycle to determine whether the lamp has been lighted in response to the high voltage starting pulse delivered in the preceding half-cycle.

After an equality condition has been detected at 162, the program flow moves through the steps 160, 152, 154 and 162. When the step 162 is reached the second time after the equality condition was first detected at 162, the elapsed time will not be equal to the warm-up time period, because the elapsed time will be greater than the warm-up time period. The program flow will then move to step 164 and wait for the switch trigger time. The waiting which occurs at step 164 allows the energy to the transferred to promote ignition. The waiting time gives the lamp a chance to light.

If the high voltage starting pulse did not succeed in lighting the lamp, as determined at 166 as a result of checking the voltage between the lamp cathodes, the timer is set to the supplementary warm-up time period by subtracting from the initial warm-up time period a time amount represented by T2, as shown at 168. Subtracting the time amount T2 from the initial warm-up period results in a reduced supplementary warm-up period established at 168. The supplementary warm-up period may be less in time than the initial warm-up time period because the cathodes are already heated to some level, although not enough to result in starting the lamp. The counter is also reset to zero at 168, because it will be necessary to again check the lamp to determine whether it has been lighted after the expiration of the supplementary warm-up period.

The program flow during the supplementary warm-up time period is entirely similar to the program flow executed during the initial warm-up time period except that the length of the supplementary warm-up time period is reduced.

The program flow continues until the lamp is lighted as is determined at 166. Once the lamp is lighted the switch is triggered at 170 and the counter is incremented. Incrementing the counter at 170 allows the lamp voltage to be checked for the N number of half-cycles. After the selected number N of half-cycles is reached, as determined at step 172, the program flow continues by reverting back to step 152. Should the lamp voltage be detected as increasing above the normal operating voltage expected from a lighted lamp during the N cycles, the reversion of the program flow to step 152 will assure that a supplementary warm-up time period will be entered to preheat and restart the lamp.

Once a number of half-cycles which equal the selected number N have occurred, and the lamp has remained lighted, the program flow will be completed as shown at step 174. Under these conditions the lamp is considered to be fully ignited and operating stably, allowing the starting sequence of preheating and igniting the lamp to end at 174.

From the previous description it is apparent that the present invention effectively suppresses the high voltage starting pulses during the time when the cathodes have not been heated sufficiently to start the lamp. During conditions when the cathodes are insufficiency heated, the condition of positive ion bombardment is avoided. The thermionic coating on the cathodes is preserved, as is the useful lifetime of the lamp.

In addition to obtaining these useful improvements, the control module can be programmed to regulate the voltage and current supplied from the resonant circuit to the lamp, as described in the U.S. patent application Ser. No. 08/530,563 and 08/531,037. Further still, the control module may be programmed to dim the lamp or otherwise exercise illumination control over the fluorescent lamp. Numerous other advantages and improvements result from the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

The invention claimed is:

1. A preheating and ignition circuit for use with a fluorescent lamp which has cathodes and a medium which is ionizable into a conductive plasma by voltage and current applied in half-cycles from a power source through a ballast to the lamp, comprising:

a control module adapted to be connected to the cathodes of the lamp;

the control module including a controllable switch which is connected in series with the cathodes upon connection of the control module to the cathodes, the switch conducts substantially all of the current applied to the cathodes from the power source when the switch is conductive, the switch having a characteristic holding current level, the switch remaining conductive after being triggered when the current flow therethrough exceeds the holding current level, the switch commutating into a non-conductive state if not triggered upon the current therethrough decreasing below the holding current level;

the control module further including a controller for controlling the conductivity of the switch relative to the current flow therethrough by supplying signals to trigger the switch;

the controller including information defining a warm-up time period of predetermined time duration of two or more complete applied half-cycles during which the cathodes are heated prior to attempting to ignite the lamp;

the controller delivering a conductive interval start signal to trigger the switch into a conductive state during a predetermined conductive time interval during each applied half-cycle occurring during the warm-up time period, the switch conducting current through the cathodes and thereby heating the cathodes during the conductive time interval of each applied half-cycle during the predetermined warm-up time period;

the controller causing the switch to commutate into a nonconductive state at the end of the conductive time interval occurring in the next half-cycle after the expiration of the warm-up time period as a result of current conducted through the switch decreasing to below the holding current level, the commutation of the switch into the non-conductive state upon the current conducted therethrough decreasing to below the holding current level creating a change in current per change in time (di/dt) effect at the ballast which applies a high voltage ignition pulse to the cathodes; and the controller delivering a suppression signal in addition to the interval start signal during each applied half-cycle occurring during the warm-up time period, the suppression signal triggering the switch into a conductive state prior to the end of the conductive time interval and while the current conducted through the switch reaches the holding current level during each applied half-cycle of the predetermined warm-up time period.

2. A method of preheating and ingniting a plasma in a fluorescent lamp which has cathodes and a medium which is ionizable into the plasma, comprising the steps of:

connecting a ballast between an AC power source and the lamp;

applying voltage and current in half-cycles from the AC power source to the cathodes;

heating the cathodes for a predetermined warm-up time period extending over two or more complete applied half-cycles of current by conducting current from the source through the cathodes for a predetermined conductive time interval of each applied half-cycle of current during the warm-up time period;

conducting current from the source through the cathodes for the predetermined conductive time interval of a half-cycle of current occurring immediately after the warm-up time period;

generating a relatively high voltage starting pulse by creating a relatively large decrease in current conducted through the ballast in a relatively short time (di/dt effect) at the end of the conductive time interval;

suppressing the high voltage starting pulse by suppressing the di/dt effect at the end of each conductive time interval occurring during the predetermined warm-up time period;

applying the relatively high voltage starting pulse to the cathodes at the end of the conductive time interval occurring in the half-cycle occurring immediately after the warm-up time period;

connecting a controllable switch to the cathodes to conduct substantially all of the current applied to the cathodes through the cathodes when the switch is triggered into a conductive state during the conductive time interval, the switch having a characteristic holding current level, the switch remaining conductive after being triggered when current flow therethorugh exceeds the holding current level, the switch commutating into a non-conductive state if not triggered when the current therethrough decreases below the holding current level;

delivering a conductive start signal during each half-cycle of applied current during the warm-up time period to trigger the switch into a conductive state at the start of the conductive time interval; and delivering a suppression signal during each half-cycle of the warm-up time period to trigger the switch into the conductive state prior to and during the end of the conductive time interval during each half-cycle of the warm-up time period, the suppression signal existing when the current conducted through the switch reaches the holding current level.

3. A method as defined in claim 2 further comprising the steps of:

using a semiconductor switch having a characteristic holding current level as the controllable switch;

generating the di/dt effect by ceasing to deliver the suppression signal and allowing the semiconductor switch to commutate into a nonconductive state when the half-cycle of applied current decreases below the holding current level of the semiconductor switch.

4. A preheating and ignition circuit as defined in claim 1 wherein:

the controller ceases to deliver the suppression signal during at least one applied half-cycle following the expiration of the predetermined warm-up time period to allow the switch to commutate into the nonconductive state in response to the decrease of the current conducted therethrough to a value below the holding current level of the switch, the di/dt effect from the commutation of the switch creating a high voltage ignition pulse for igniting the lamp during each one half-cycle following the expiration of the warm-up time period.

5. A preheating and ignition circuit as defined in claim 4 wherein:

the control module further includes a zero crossing detector to determine zero crossing points of the applied half-cycles of current; and the controller delivers the suppression signal at a predetermined time relative to a detected zero crossing point.

6. A preheating and ignition circuit as defined in claim 5 wherein the predetermined time at which the suppression signal is delivered occurs at a time when the applied half-cycle of current conducted through the switch is greater than the predetermined holding current level of the switch.

7. A preheating and ignition circuit as defined in claim 1 wherein:

a blocking circuit element is connected to the ballast;

the applied half-cycles of current from the power source are conducted to the ballast through the blocking circuit element;

the blocking circuit element blocks direct current flow from the power source to the lamp; and the switch conducts current through the cathodes to warm the cathodes during the conductive time interval of each half-cycle occurring during the warm-up time period.

8. A preheating and ignition circuit as defined in claim 7 wherein:

the blocking circuit element includes a capacitor connected to the ballast, and the capacitor and the ballast form a resonant circuit having a resonant circuit frequency;

the power source is an AC source having a predetermined power delivery frequency; and the AC power source drives the resonant circuit frequency at the predetermined power delivery frequency.

9. A preheating and ignition circuit as defined in claim 1 wherein:

the control module further includes a voltage sensor which is connected to the cathodes upon connection of the control module to the cathodes, the controller is connected to the voltage sensor by which to sense the voltage between the cathodes and across the plasma after the expiration of the predetermined warm-up time period and after the application of the high voltage ignition pulse to the cathodes.

10. A preheating and ignition circuit as defined in claim 9 wherein:

the controller senses the voltage between the cathodes to determine if the plasma has ignited during each of a predetermined number of half-cycles occurring after the expiration of the warm-up time period.

11. A method as defined in claim 3 further comprising the steps of:

detecting zero crossing points of the half-cycles of applied current conducted through the cathodes during the warm-up time period; and suppressing the high voltage starting pulse at a predetermined time relative to a detected zero crossing point.

12. A preheating and ignition circuit as defined in claim 10 wherein:

the controller senses the voltage between the cathodes at a predetermined consistent time instant during each of the predetermined number of half-cycles occurring after expiration of the warm-up time period.

13. A preheating and ignition circuit as defined in claim 10 wherein:

the controller includes further information defining a second supplementary warm-up time period after expiration of the first aforesaid in initial warm-up time period; and the controller establishes the supplementary warm-up time period if the voltage sensed between the cathodes represents that the plasma has not ignited.

14. A preheating and ignition circuit as defined in claim 13 wherein the supplementary warm-up time period is of a predetermined time duration less than the predetermined time duration of the initial warm-up time period.

15. A preheating and ignition circuit as defined in claim 13 wherein:

the controller senses the voltage between the cathodes to determine if the plasma has ignited during each of a predetermined number of half- cycles occurring after the expiration of the supplementary warm-up time period.

16. A preheating and ignition circuit as defined in claim 15 wherein the control module senses the voltage between the cathodes at a predetermined consistent time instant during the predetermined number of half-cycles occurring after the expiration of the supplementary warm-up time period.

17. A preheating and ignition circuit as defined in claim 4 wherein the controller ceases to deliver the suppression signals during a predetermined number of applied half-cycles following the expiration of the predetermined warm-up time period.

18. A preheating and ignition circuit as defined in claim 17 wherein the predetermined number of applied half-cycles following the expiration of the warm-up time period encompasses one.

19. A preheating and ignition circuit as defined in claim 17 wherein:

the commutation of the controllable switch into the non-conductive state creates a change in current per change in time (di/dt) effect which causes the ballast to apply a high voltage starting pulse to the cathodes to attempt to ignite the medium into a plasma;

the control module includes a voltage sensor to sense the voltage between the cathodes and across the plasma after the occurrence of the high voltage starting pulse following expiration of the predetermined warm-up time period;

the controller including information defining a second supplementary warm-up time period in addition to the first aforesaid initial warm-up time period, the supplementary warm-up time period having a predetermined time duration less than the initial warm-up time;

the controller delivering the interval start signal to trigger the switch into a conductive state during a predetermined conductive time interval during each applied half-cycle occurring during the supplementary warm-up time period to conduct current through the cathodes and thereby heat the cathodes during the supplementary warm-up time period;

the controller causing the switch to commutate into a nonconductive state at the end of the conductive time interval occurring in the next occurring half-cycle after the expiration of the supplementary warm-up time period; and the controller delivering a suppression signal in addition to the interval start signal during each applied half-cycle during the supplementary warm-up time period, the suppression signal triggering the switch into a conductive state prior to the end of the conductive time interval and before the current conducted through the switch reaches the holding current level during each applied half-cycle of the supplementary warm-up time period.

20. A method as defined in claim 3 further comprising the step of:

determining if the plasma is ignited after the expiration of the predetermined warm-up time period and after applying the high voltage starting pulse.

21. A method as defined in claim 20 wherein the supplementary warm-up time period is of less time duration than the initial warm-up time period.

22. A method as defined in claim 3 further comprising the steps of:

connecting a blocking circuit element and the ballast between the AC power source and the lamp; and blocking direct current flow from the AC source to the lamp by using the blocking circuit element.

23. A method as defined in claim 22 further comprising the steps of:

using a capacitor as the blocking element; and connecting the capacitor and the ballast in a resonant circuit between the lamp and the AC source.

24. A method as defined in claim 20 further comprising the steps of:

establishing a second supplementary warm-up time period in addition to the first aforesaid initial warm-up period, the second warm-up period occurring after expiration of the first warm-up time period, if the plasma has not ignited.

25. A method as defined in claim 24 further comprising the step of:

determining if the plasma has ignited during each of a a predetermined number of half-cycles occurring after the expiration of the initial and supplementary warm-up time periods.

* * * * *